US008079571B2

(12) United States Patent
Nishita et al.

(10) Patent No.: US 8,079,571 B2
(45) Date of Patent: Dec. 20, 2011

(54) SHOCK-ABSORBING FENCE

(75) Inventors: Yoichi Nishita, Niigata (JP); Tomohiro Fujii, Niigata (JP); Toshimitsu Nomura, Niigata (JP)

(73) Assignee: Protec Engineering Inc., Niigata (JP)

( * ) Notice: Subject to any disclaimer, the term of this patent is extended or adjusted under 35 U.S.C. 154(b) by 0 days.

(21) Appl. No.: 12/850,427

(22) Filed: Aug. 4, 2010

(65) Prior Publication Data

US 2010/0327244 A1 Dec. 30, 2010

Related U.S. Application Data

(63) Continuation of application No. PCT/JP2008/000943, filed on Apr. 10, 2008.

(30) Foreign Application Priority Data

Feb. 6, 2008 (JP) ..... 2008-026345

(51) Int. Cl.
*E01F 7/02* (2006.01)

(52) U.S. Cl. ..... 256/12.5; 256/35; 256/45

(58) Field of Classification Search ..... 256/1, 12.5, 256/23, 35, 36, 45; 405/302.7
See application file for complete search history.

(56) References Cited

U.S. PATENT DOCUMENTS

| | | | | |
|---|---|---|---|---|
| 4,366,949 | A * | 1/1983 | Staub, Sr. | 256/12.5 |
| 5,299,781 | A * | 4/1994 | Barrett et al. | 256/12.5 |
| 5,961,099 | A * | 10/1999 | Thommen, Jr. | 256/12.5 |
| 6,592,103 | B2 * | 7/2003 | Sennhauser | 256/12.5 |
| 7,562,453 | B1 * | 7/2009 | Benner et al. | 256/1 |

FOREIGN PATENT DOCUMENTS

| | | | |
|---|---|---|---|
| CH | 667 376 | * | 5/1991 |
| JP | 05-295713 | | 9/1993 |
| JP | 06173221 | | 6/1994 |
| JP | 06336709 | | 12/1994 |
| JP | 07197423 | | 8/1995 |
| JP | 09013330 | | 1/1997 |
| JP | 2002275835 | | 9/2002 |
| JP | 2003261910 | | 9/2003 |
| JP | 2006090088 | | 4/2006 |
| JP | 2007032032 | | 2/2007 |
| WO | 2008/081557 | | 7/2008 |

* cited by examiner

*Primary Examiner* — Michael P Ferguson
(74) *Attorney, Agent, or Firm* — Seed IP Law Group PLLC

(57) ABSTRACT

A shock-absorbing fence comprises: a guard net provided in a stretched state between main posts provided to stand at a predetermined interval; a safety net attached between a skirt of the guard net and a ground; and a member joining an upper rim of the safety net to the skirt of the guard net as well as securing a lower rim of the safety net to the ground, the member including a horizontal support rope member provided along the lower rim of the safety net and a plurality of hillside support rope members connecting between a plurality of points of the horizontal support rope member and a plurality of hillside anchors, the safety net being allowed to deform in an extended manner following deflection and deformation of the guard net, while maintaining a gap below the guard net in a closed state, in case of rockfall.

9 Claims, 6 Drawing Sheets

SHOCK-ABSORBING FENCE

CROSS REFERENCE TO RELATED APPLICATIONS

This is a continuation application of International Patent Application No. PCT/JP2008/000943 filed Apr. 10, 2008 claiming priority upon Japanese Patent Application No. 2008-026345 filed Feb. 6, 2008, of which full contents are incorporated herein by reference.

BACKGROUND

1. Technical Field

The present invention relates to a shock-absorbing fence that absorbs impacts of falling objects such as falling rocks and soil, and in particular relates to a shock-absorbing fence that has the improved capability to capture falling rocks.

2. Description of the Related Art

In Japanese Patent Application Laid-Open Publication No. H7-197423, there is disclosed a shock-absorbing fence that includes: tubular main posts built in vertical holes bored at intervals on a hillside slope to be provided in a standing state; and a net formed of metallic mesh provided in a stretched state on each of the tubular main posts along with cables at a plurality of stages.

There is also proposed a shock-absorbing fence for absorbing impacts of falling rocks and the like by converting the impact energy into the friction energy, which includes as the basic configuration: main posts provided to stand at predetermined intervals; horizontal rope members anchored between the main posts in a horizontally slidable manner and secured at both ends thereof; and a wire net retained on the horizontal rope members to cover a space between the main posts. In addition to the basic configuration, the proposed shock-absorbing fence further includes as an absorbing section: an extra length section formed by overlapping rope members in the middle of the horizontal rope members; and a clump that clumps the extra length section with a certain strength. In case a tensile force beyond the predetermined level is applied to the horizontal rope members, the extra length section can extend to absorb the tensile force while a certain friction force is maintained on the horizontal rope members (see for example, Japanese Patent Application Laid-Open Publication No. H6-173221, and Japanese Patent Application Laid-Open Publication No. H6-336709).

(1) This is a type of shock-absorbing fence configured to stop falling rocks and the like in a band-shaped net stretched across main posts. When such a shock-absorbing fence catches falling rocks, the midsection of the net deflects and deforms by a large amount toward the foot of a slope, and at the same time, the height (effective height) of the fence changes by a large amount.

In other words, the net deflects and deforms by a large amount in and around the region hit by falling rocks, and due to such deformation, the length between the upper and lower rims of the net (net width in its height direction) becomes shorter.

As a result, in case that rockfalls occur in a repetitive manner, rocks from subsequent rockfalls can slip through a gap wide open between the bottom end of the net and the ground, and the rocks may jump over the net, posing problems in its capability to trap falling rocks.

(2) If cost is not taken into account, it is possible to enhance capability to trap falling rocks by reducing the amount of deformation by utilizing a large quantity of absorbers, increasing the number of ropes, and installing a multiple layer of shock-absorbing fences.

However, in light of the current severe economic environment, it is difficult to implement costly countermeasures as mentioned above, and for this reason, it is much needed to propose a shock-absorbing fence whose installation costs can be lowered without sacrificing the protection performance.

BRIEF SUMMARY

An object of the present invention is to solve the problems listed above, and to provide a shock-absorbing fence that meets at least one of the following requirements:

(1) To reduce the change of the effective height of a guard net in case of rockfall;

(2) To enhance safety by improving the capability to trap falling rocks;

(3) To improve shock absorption capabilities while maintaining low costs; and (4) To be constructed easily.

A shock-absorbing fence according to an aspect of the present invention comprises: a guard net provided in a stretched state between main posts provided to stand at a predetermined interval; a safety net attached between a skirt of the guard net and a ground; and a member joining an upper rim of the safety net to the skirt of the guard net as well as securing a lower rim of the safety net to the ground, the member including a horizontal support rope member provided along the lower rim of the safety net and a plurality of hillside support rope members connecting between a plurality of points of the horizontal support rope member and a plurality of hillside anchors, the safety net being allowed to deform in an extended manner following deflection and deformation of the guard net, while maintaining a gap below the guard net in a closed state, in case of rockfall.

In the shock-absorbing fence according to another aspect of the present invention, the guard net includes: upper and lower horizontal rope members extended horizontally between the main posts, the upper and lower horizontal rope members configured to serve as a damper; a diagonal rope member extended diagonally between the main posts, the diagonal rope member configured to serve as a damper; and a mesh member in a band shape attached to the upper and lower horizontal rope members and the diagonal rope member.

In the shock-absorbing fence according to still another aspect of the present invention, the mesh member and the safety net are formed of metallic mesh.

In the shock-absorbing fence according to still another aspect of the present invention, the safety net is rhombic metallic mesh capable of being rather extended in a longitudinal direction of a slope than extended in a transverse direction of the slope.

The present invention can provide at least one of the following advantageous effects:

(1) When hit by falling rocks, the safety net moves along with the guard net stretched between the main posts, thereby to ensure entrapment of the falling rocks.

(2) In case of rockfall, the safety net extends in a manner following deflection and deformation of the guard net while maintaining a gap below the guard net closed, thereby to reduce the change of the effective height of the guard net. In this way, falling rocks are prevented from slipping through or jumping over the safety net, and the capability to trap falling rocks is greatly improved.

(3) The section where the safety net is attached to the guard net is reinforced as the double-layered structure, thereby to enhance the safety reliability of the shock-absorbing fence.

(4) When hit by falling rocks, the amount of the impact energy absorbed accompanying the weight shift of the guard net increases by the weight of the safety net, and the amount of the impact energy absorbed also increases by the friction resistance between the hillside slope and safety net.

As a result, there is less deflection and deformation of the guard net than before.

In particular, it is suitable for installation in locations adjacent to road infrastructure, railroad facility, and housing, for example, where the amount of deflection and deformation of the guard net is strictly limited.

(5) Installation can be performed with simple additional work of attaching a safety net which exerts absorption of impact force to a shock-absorbing fence, and thus, a low-cost shock-absorbing fence with high shock-absorbing performance can be provided.

(6) The technology is very versatile, as it can be applied to a variety of well-known shock-absorbing fences equipped with main posts and guard nets.

(7) The installation merely involves: bringing in component members of the shock-absorbing fence into the site; providing tilted main posts to stand without laying concrete foundation; providing to stretch a plurality of rope members and a mesh member; and attaching a safety net to the skirt of the mesh member, and thus, it is suitable for installation in mountain areas and precipitous terrains to which heavy vehicles are less accessible.

BRIEF DESCRIPTION OF THE SEVERAL VIEWS OF THE DRAWINGS

For more thorough understanding of the present invention and advantages thereof, the following description should be read in conjunction with the accompanying drawings, in which.

DETAILED DESCRIPTION

Hereinafter, an embodiment of the present invention will be described with reference to the accompanying drawings.

(1) Entire Configuration of a Shock-Absorbing Fence

Figure 1:
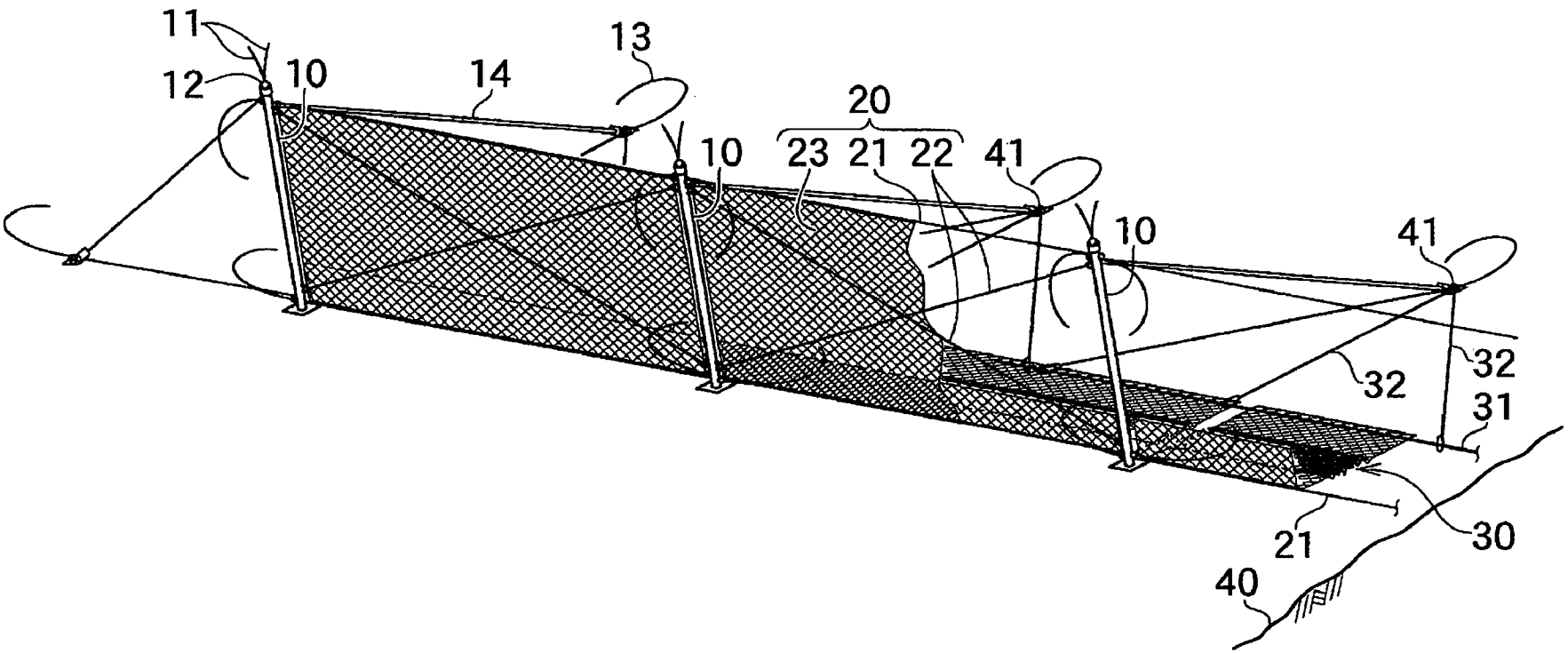
FIG. 1 is a perspective view illustrating a partially omitted shock-absorbing fence according to an embodiment of the present invention.
Figure 2:
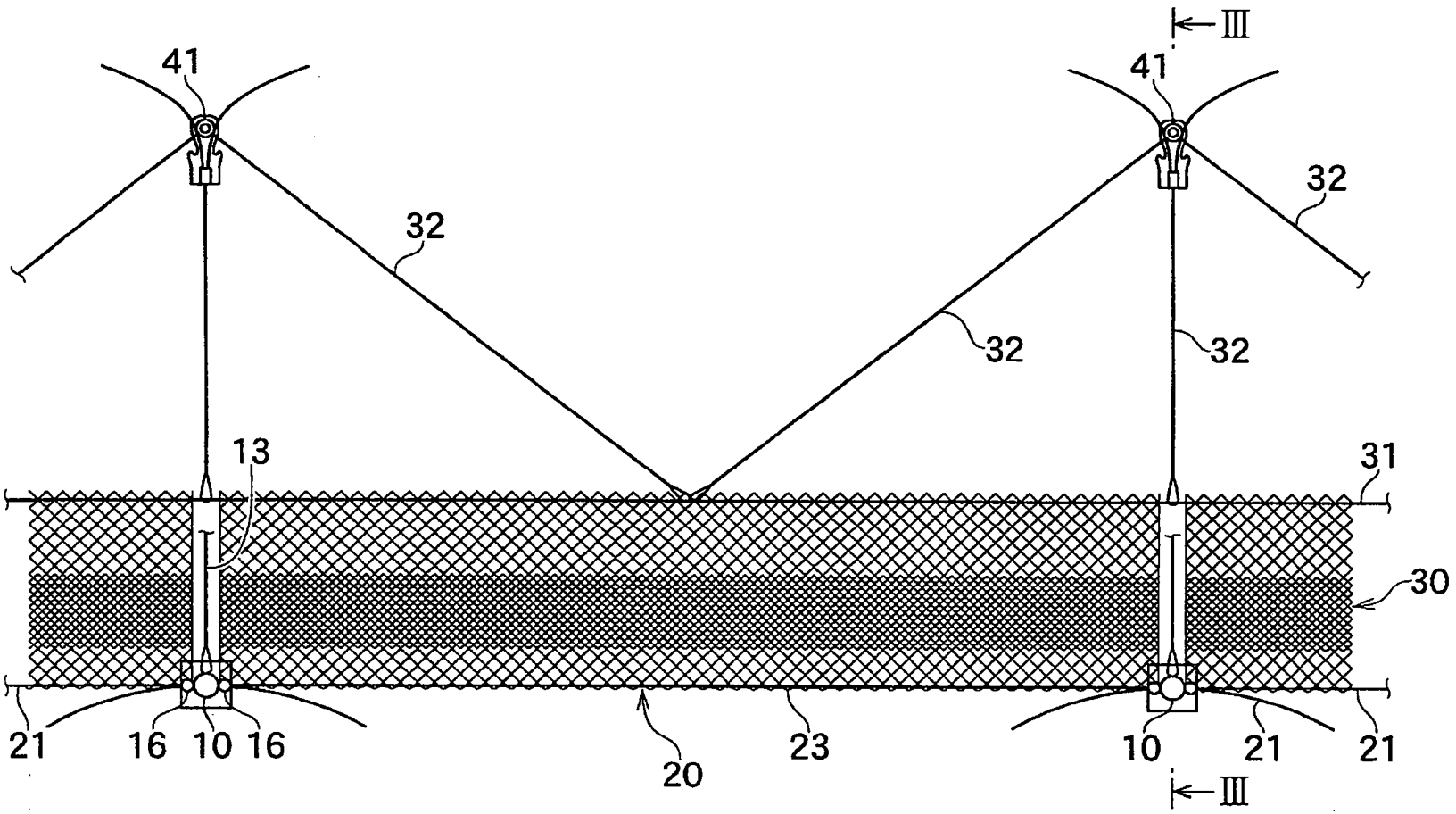
FIG. 2 is a top view illustrating a shock-absorbing fence.

FIGS. 1 and 2 illustrate one example of a shock-absorbing fence according to the embodiment of the present invention.

It is assumed that the present invention includes a shock-absorbing fence equipped with main posts 10 provided to stand at predetermined intervals and a guard net 20 stretched across the main posts 10. Moreover, the present invention is provided with a safety net 30 installed between the skirt of the guard net 20 and a slope 40 as means for reducing the change of the effective height of the guard net 20.

The shock-absorbing fence in this embodiment is only exemplary and it can be applied to a variety of well-known shock-absorbing fences as long as it is equipped with protective nets.

Hereinafter, the configuration of a shock-absorbing fence according to an embodiment of the present invention will be described in details.

(2) Main Post

Main posts 10 to be provided to stand at predetermined intervals on a slope 40 is each formed of a hollow tube member. Conventional, standard main posts are provided to stand on concrete foundation laid on the installation position. In this embodiment, however, installation of the concrete foundation is omitted, and the main posts 10 are installed in a tiltable manner with respect to the slope 40.

In advance, an anchor or a lock bolt is fixed in the ground at the installation position of each main post 10, and a main post rope member 11 integrally connected to the anchor or lock bolt is exposed on the surface of the ground.

Figure 3:
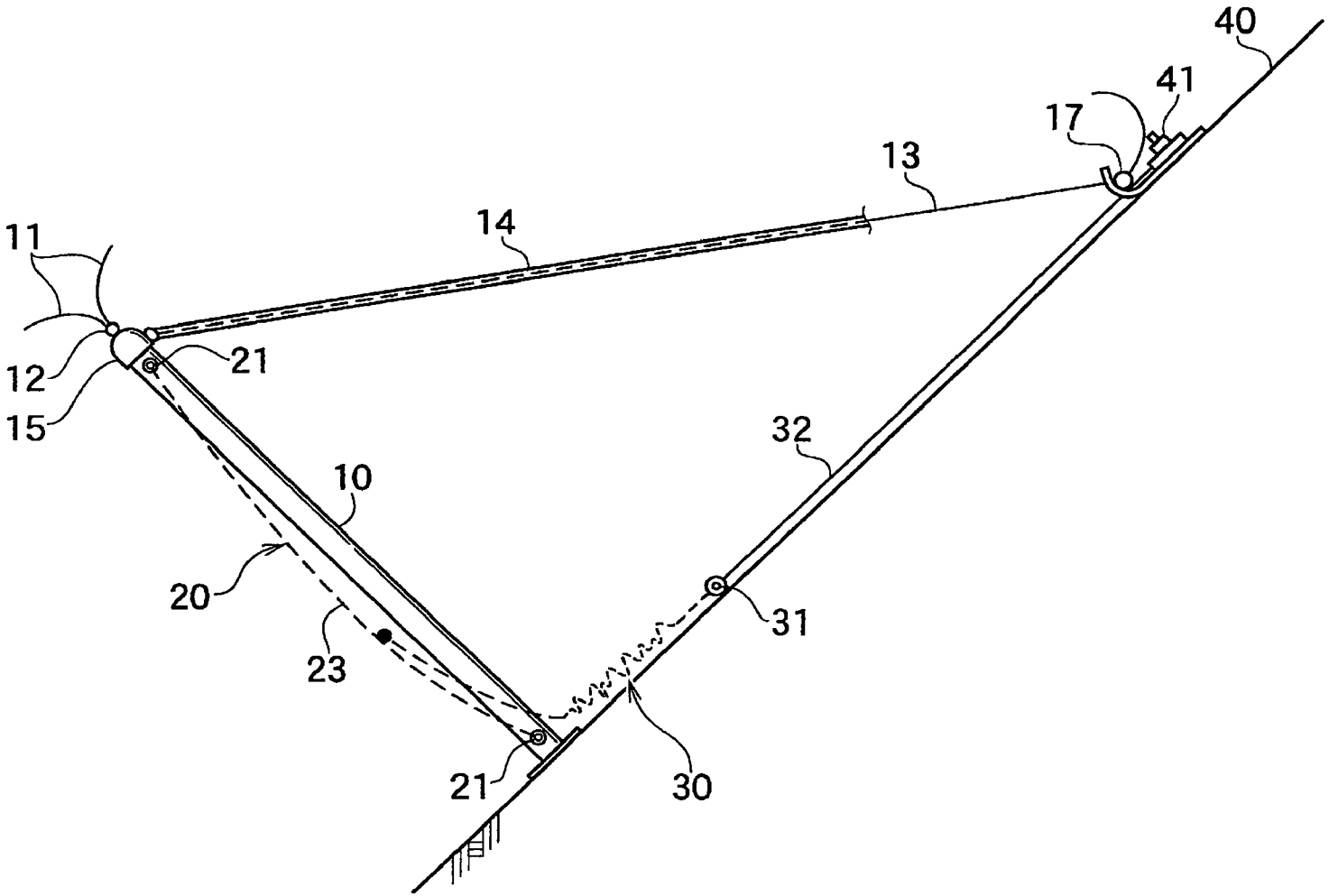
FIG. 3 is a section view illustrating the section III-III in FIG. 1.
Figure 4:
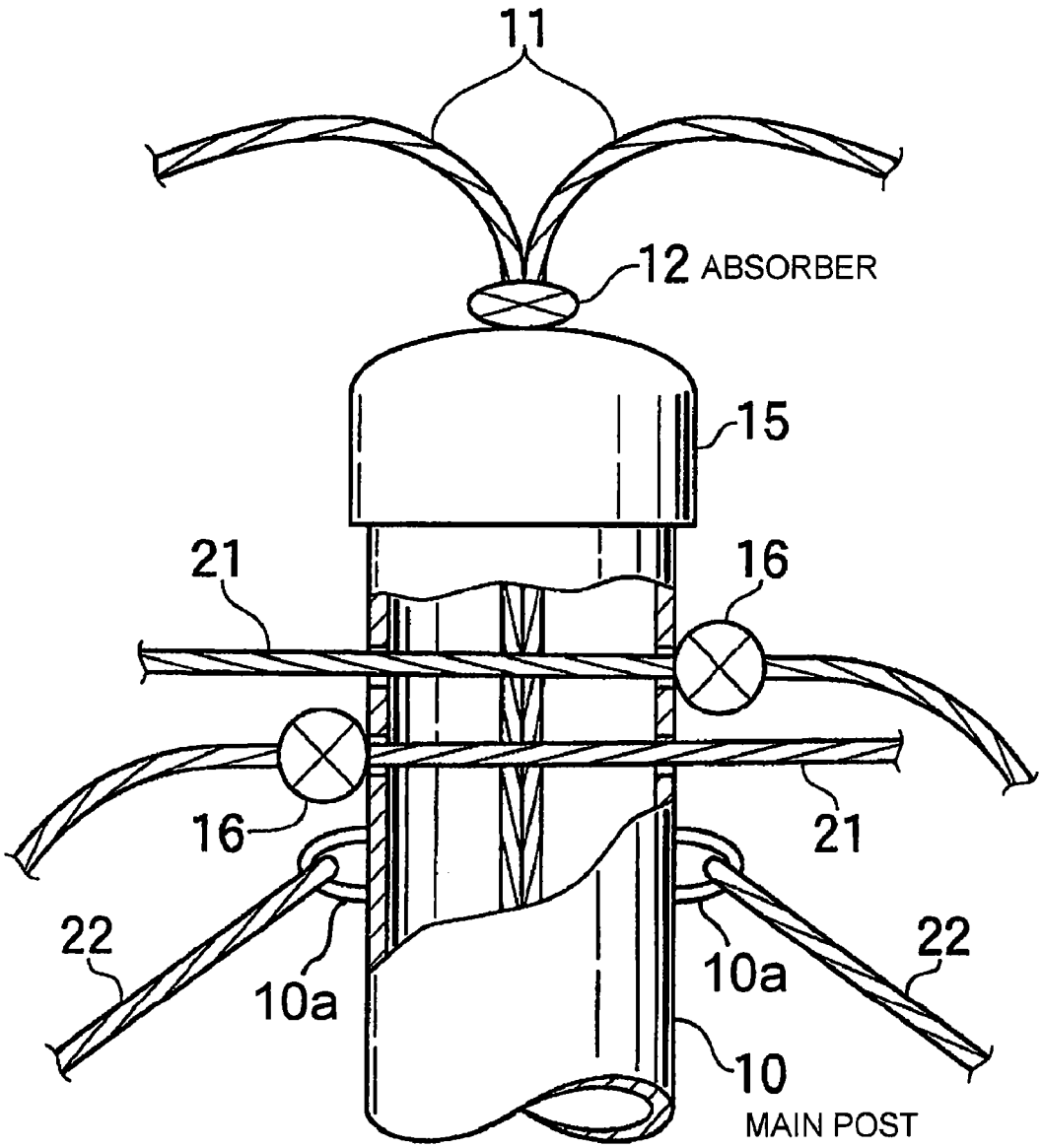
FIG. 4 is an enlarged view illustrating the top part of a main post to indicate connection configuration of horizontal rope members.

Then, as illustrated in FIGS. 3 and 4, the main post rope member 11 is inserted inside the main post 10 through from the lower opening, and then an absorber 12 is secured at the base of the main post rope member 11 projected from the upper opening of the main post 10, so that the main post 10 is installed in a manner to maintain the standing attitude.

In this embodiment, there is provided an example that the main post rope member 11 pulled out of a main post cap 15 covering the top of the main post 10, and that the base of the main post rope member 11 secured by an absorber 12 with a size unslippable through the opening of the main post cap 15.

The absorber 12 allows the main post rope member 11 to slide when a tensile force beyond friction resistance is applied between the main post rope member 11 and the gripping section of the absorber 12, and damps the impact energy when the main post 10 is tilted.

As an absorber 12, well-known friction-resistance type absorbers such as those formed of two plate bodies clamped together by bolts and nuts can be used.

As appropriate, a supporting rope 13 may also be connected between each of top and bottom parts of the main post 10 and the anchor 41 on the slope 40, and an absorber 17 may be provided in an appropriate manner at the end or in the middle of the supporting rope 13.

In this embodiment, a tubular support 14 covers the exterior of the supporting rope 13 which is connected to the top part of each main post 10, thereby to prevent a fence from falling toward the hillside in case of rockfall.

(3) Guard Net

A guard net 20 is a member to stop falling rocks and the like. In this embodiment, as illustrated in FIG. 1, the guard net includes: upper and lower horizontal rope members 21; diagonal rope members 22 extended across main posts 10; and a mesh member 23 attached to the rope members 21 and 22 via helical coils and the like.

The rope members 21, 22 and the mesh member 23 are combined in order to eventually transmit to the main posts 10 the impact force of falling rocks transmitted from the mesh member 23 as well as the impact force and loads acting directly on the rope members 21 and 22, and also in order to absorb efficiently the impact energy in synergy with the mesh member 23.

Also, in order to allow transmission of a large force between the rope members 21, 22 and the mesh member 23, each of the rope members 21 and 22 is woven through each mesh of the mesh member 23, or the rope members 21 and 22 placed one side of the mesh member 23 are bundled to be stitched onto the mesh member 23 by means of helical coils.

Hereinafter, component members of the guard net 20 will be described in details.

(3-1) Rope Member

An absorber 12 is installed near the end of each of the upper and lower horizontal rope members 21 stretched laterally across the main posts 10 to provide these rope members 21 with shock-absorbing function.

Each of the upper and lower horizontal rope members 21 is stretched laterally across the main posts 10 in a continuous manner.

In this embodiment, the upper and lower horizontal rope members 21 are provided in a stretched state between the main posts 10 adjacent to each other; however, it goes without saying that the upper and lower horizontal rope members 21 may be provided in a stretched state between the main posts 10 distant beyond the installation span thereof. FIG. 4 is an enlarged view of connection configuration of the horizontal rope members 21 illustrated in FIGS. 1 and 2. In this embodiment, two adjacent horizontal ropes 21 are connected with each other via the main post 10 positioned therebetween in such a manner that the two horizontal rope members 21 are provided to penetrate respectively two parts of the main post 10 different in height, and that absorbers 16 in a laterally pairwise manner are installed to hold respectively the ends of the two rope members 21 penetrating and jutting out the two parts and to abut respectively on both sides of the main post 10.

Figure 5:
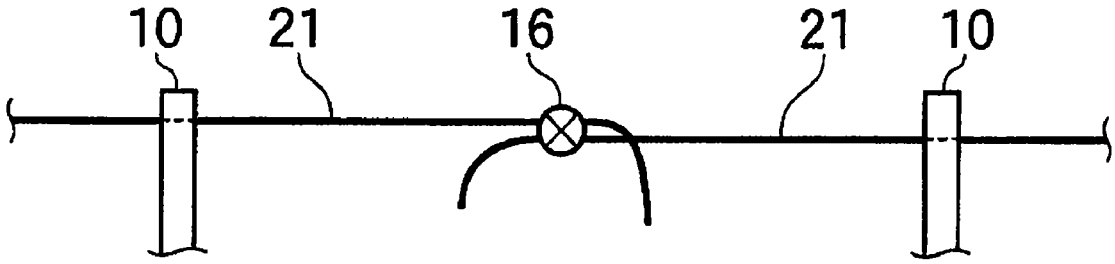
FIG. 5 is an upper half view illustrating a shock-absorbing fence to indicate another connection configuration of horizontal rope members.

FIG. 5 illustrates a configuration where two horizontal rope members 21 are connected through an absorber 16 that does not abut on the main posts 10. In this embodiment, the two horizontal rope members 21 penetrating respectively the main posts 10 are overlapped between the main posts 10, and the overlapped section of the two horizontal rope members 21 are held by the absorber 16, thereby connecting between the two adjacent horizontal rope members 21.

The configuration of the horizontal rope members 21 stretched laterally at the lower parts of the main posts 10 is similar to the configuration of the horizontal rope members 21 stretched laterally at the upper parts of the main posts 10 shown in FIGS. 4 and 5, and thus, the illustration of the former configuration is omitted.

An absorber 16 has only to serve as holding one or two rope members 21, and serve as the damping energy while allowing the rope members 21 to slide, when the rope members 21 are applied with a tensile force beyond the level of friction resistance of the gripping section, and therefore, a well-known friction resistance type of absorbers such as those formed of two plate bodies clamped together by bolts and nuts, for example, can be used for the absorber 16.

Diagonal rope members 22 are extended across the upper and lower parts of the adjacent main posts 10 to cross each other. As shown in FIG. 4, the diagonal rope members 22 may be extended across hooks 10*a* protruded respectively from the upper and lower sides of the main posts 10, and absorbers such as wire clips (not shown) may be arranged close to the end or in the middle of the diagonal rope members 22.

(3-2) Mesh Member

A mesh member 23 is formed of a mesh net of reticulated high-strength fiber such as metallic mesh and aramid fiber, or of a plastic mesh net. In consideration of the workability and cost, a rhombic metallic mesh is preferred.

As illustrated in FIG. 1, the mesh member 23 is joined in a movable manner to the entire length or a part of the rope members 21, 22 by wrapping helical coils and the like around the mesh member 23 and rope members 21, 22.

The rhombic metallic mesh used for the mesh member 23 inherently has difference in the degree of extensibility between vertical and horizontal directions due to the manufacturing process. For this reason, when fixing the mesh member 23 between main posts 10, the rhombic metallic mesh should be so arranged as to be rather extended in a horizontal direction than extended in a vertical direction in FIG. 1, in order to achieve the improved capability of mesh member 23 to capture falling rocks.

(4) Safety Net

A safety net 30 has a length longer than the gap between the guard net 20 and the slope 40, and is formed of a mesh net of reticulated high-strength fiber such as metallic mesh and aramid fiber. In consideration of the workability and cost, a rhombic metallic mesh is preferred.

One (top) end of the safety net 30 is integrally joined to the skirt of the mesh member 23 by wrapping helical coils and the like around the one end and the skirt, whereas the other (bottom) end of the safety net 30 is secured to the slope 40, thereby covering the gap created between the skirt of the mesh member 23 and the slope 40.

As shown in FIG. 2, in this embodiment, there are connected respectively between: a plurality of locations on a horizontal support rope member 31 integrally attached along the other (bottom) end of a plurality of safety nets 30; and a plurality of hillside support rope members 32 extended from anchors 41 installed on the hillside of the slope 40, so that the anchors 41 can support the external force applied to the safety net 30.

Anchor pins and the like may also be used to secure the other (bottom) end of the safety net 30 directly to the slope 40.

The safety net 30 has a combination of: the function of closing a gap below the skirt of the mesh member 23 to prevent falling rocks from physically slipping through; and the function of reducing the change of the effective height of the guard net 20 in case of rockfall.

For that purpose, as illustrated in FIG. 3, the middle or lower portion of the safety net 30 should be slacked in a bellows shape, folded up or folded back, or the like to be provided with a sufficient length, thereby having such a margin as to expand toward the foot of a hill to follow the deflection and deformation of the safety net 20 in case of rockfall.

Therefore, the total length of the safety net 30 should be adopted appropriately in accordance with the conditions of the site, since such a total length effects on the amount of deflection/change of the guard net 20 toward the foot of the slope/the effective height of the guard net 20, in case of rockfall.

The overlapped area where the safety net 30 is installed over the guard net 20 is reinforced by the double-layered structure; thus, the higher the joint position between the one (top) end of the safety net 30 and the guard net 20 is, the larger the reinforced area of the guard net 20 is.

One has only to adopt appropriately the joint position between the one (top) end of the safety net 30 and the guard net 20 in accordance with the site where the shock-absorbing fence is installed.

When a rhombic metallic mesh is used for the safety net 30, such a rhombic metallic mesh should be so arranged as to be rather extended in a vertical direction (longitudinal direction of the slope 40) than extended in a horizontal direction (transverse direction of the slope 40) in FIG. 1.

Also, when the safety net 30 is arranged along the mesh member 23 as illustrated in FIG. 2, overlapping a plurality of rhombic metallic meshes is desirable.

[The Operation of the Shock-Absorbing Fence]

Figure 6:
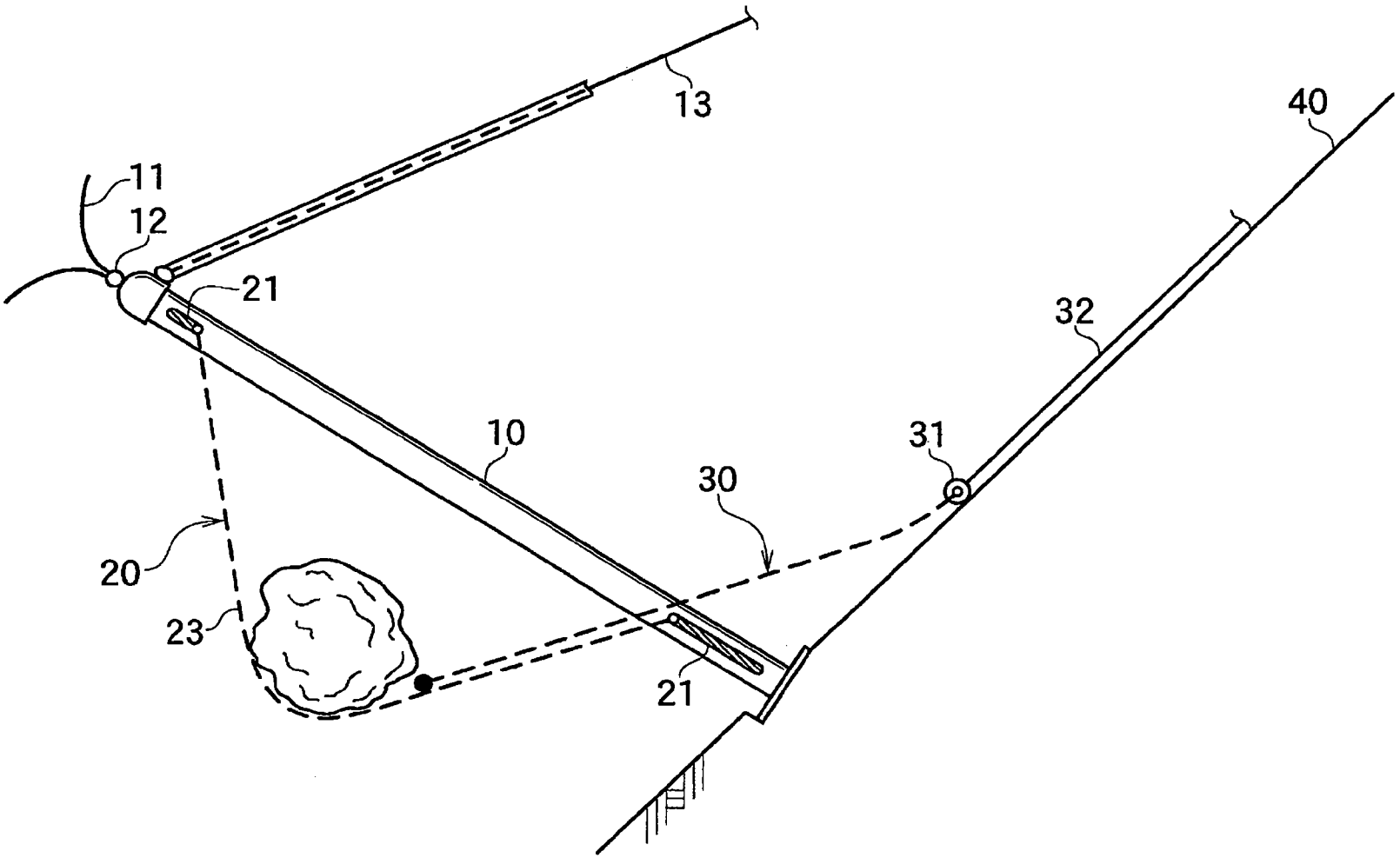
FIG. 6 is a model view illustrating a shock-absorbing fence to explain the mechanism for capturing a falling rock.

Hereinafter, the operation of the shock-absorbing fence is described based on FIG. 6.

(1) Shock Absorption by the Guard Net and Main Posts

When falling rocks and the like hit a shock-absorbing fence including the main posts 10 and the guard net 20 described above, the impact energy is damped by the sliding of wire members constituting the mesh member 23 of the guard net 20 as well as by the deflection and deformation thereof toward the foot of the slope.

Further, the impact energy applied to the guard net 20 is also applied to the rope members 21 and 23.

When the rope members 21 and 23 are applied with a tensile force beyond the level of friction resistance of the gripping section of the absorber, each of the rope members 21 and 23 slides inside the absorber resisting against the grip force of the absorber. The impact energy is damped by the friction force generated at such occasion.

The impact energy is transmitted through the mesh members 23, rope members 21 and 23, and then, ultimately to the main posts 10.

When the impact energy applied to the main posts 10 exceeds the energy corresponding to the grip force of the absorber 12 installed on top of the main posts 10, the main post rope members 11 slide inside the absorber 12, and the friction force caused by such sliding serves as a braking force against the load to absorb the impact energy, while allowing the main posts 10 to be tilted.

When the support ropes 13 are connected to the main posts 10 and the absorbers 17 are provided on these support ropes 13, the impact energy is damped by the sliding resistance between the support ropes 13 and the absorbers 17.

(2) Shock Absorption by the Safety Net

As described above, when falling rocks hit the guard net 20 of the shock-absorbing fence, the guard net 20 deflects and deforms toward the foot of the slope while the main posts 10 become tilted.

With the guard net 20 deflecting and deforming toward the foot of the slope, the safety net 30 connected to the skirt of the mesh members 23 also expand toward the foot of the hill following the deflection and deformation of the guard net 20.

The impact energy is also damped by sliding resistance, weight-shift resistance, and deformation resistance, of the safety net 30, generated at such occasion.

(3) Reduction of the Change of the Effective Height

The gap between the skirt of the guard net 20 and the slope 40 is closed by the safety net 30, thereby assuring to prevent falling rocks from slipping through the gap below the skirt of the guard net 20.

The falling rocks which hit the skirt of the guard net 20 and the safety net 30 are guided into the guard net 20 and captured therein.

The safety net 30 installed between the guard net 20 and the slope 40 not only serves as a shielding member to prevent falling rocks from slipping through, but also serves as reducing the change of the effective height of the guard net 20 as described below.

In other words, the degree of extension of the safety net 30 toward the foot of the slope in case of rockfall is greater in relation to that of the guard net 20.

Therefore, compared with the case the safety net 30 is not installed, when the safety net 30 is extended to expand toward the foot of the hill in compliance with the guard net 20 deflecting and deforming toward the foot of the slope, the tensile force applied to the upper part of the guard net 20 in the direction toward the center of the net is absorbed by a large amount.

As a result, even if the guard net 20 deflects and deforms by a large amount toward the foot of the slope, the actual effective height (fence height) of the guard net 20 does not change by a large amount.

As described above, by attaching the safety net 30 along the guard net 20, subsequent falling rocks can be not only prevented from slipping through the guard net 20, but also restrained from jumping over the guard net 20, thereby dramatically improving the capability to capture the falling rocks.

(4) Reduction of the Deflection of the Guard Net

When hit by falling rocks, the amount of the impact energy absorbed accompanying the weight shift of the guard net 20 increases by the weight of the safety net 30. Furthermore, the amount of impact energy absorbed also increases by the friction resistance between the slope 40 and the safety net 30.

As a result, the amount of deflection and deformation of the guard net 20 can be adjusted to be less than before.

(5) Other Embodiments

Described above is an embodiment where the safety net 30 is a member separable from the guard net 20, by which the gap below the skirt of the guard net 20 is closed. However, the guard net 20 may also be formed with an extended skirt section, and the extended section of the guard net 20 may be utilized as a safety net.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A shock-absorbing fence comprising:

a plurality of main posts provided to stand at a predetermined interval;

a guard net provided in a stretched state between the main posts, the guard net having an upper rim and a lower rim adjacent to a ground surface both secured to the main posts;

a safety net extending between the main posts and attached between the guard net and the ground surface, the safety net having an upper rim attached to the guard net at a predetermined level higher than the lower rim of the guard net and having a lower rim secured to the ground surface;

a plurality of main post support rope members, each main post support rope member coupled between an upper end of a respective one of the main posts and a respective one of the hillside anchors to tether the upper end of the main post to the ground surface;

a plurality of safety net support rope members each coupled between the lower rim of the safety net a respective one of the hillside anchors to secure the lower rim of the safety net to the ground surface; and a horizontal support rope member provided along the lower rim of the safety net to assist in securing the safety net to the ground surface, the plurality of safety net support ropes connected between the plurality of hillside anchors and a plurality of points of the horizontal support rope member, wherein the safety net is configured such that, when the guard net receives falling objects and moves toward a deflected configuration in which the lower rim of the guard net is deflected away from the hillside anchors, the safety net extends from a slack configuration in which the safety net includes slack between the upper rim of the safety net that is attached to the guard net and the lower rim of the safety net that is secured to the ground surface toward an extended configuration in which the safety net extends between the guard net and the ground surface to prevent a gap below the guard net and assist in damping impact energy from the falling objects.

2. The shock-absorbing fence of claim 1, wherein the guard net includes:

upper and lower horizontal rope members extended horizontally between the main posts, the upper and lower horizontal rope members configured to serve as a damper;

a diagonal rope member extended diagonally between the main posts, the diagonal rope member configured to serve as a damper; and a mesh member in a band shape attached to the upper and lower horizontal rope members and the diagonal rope member.

3. The shock-absorbing fence of claim 2, wherein the mesh member and the safety net are formed of metallic mesh.

4. The shock-absorbing fence of claim 3, wherein the safety net is rhombic metallic mesh.

5. The shock-absorbing fence of claim 1, wherein the guard net is capable of being extended in a transverse direction of the guard net to a greater degree than a longitudinal direction of the guard net.

6. The shock-absorbing fence of claim 1, wherein the safety net is capable of being extended in a longitudinal direction of the safety net to a greater degree than a transverse direction of the safety net.

7. The shock-absorbing fence of claim 1, wherein the safety net and the guard net have an overlapped area reinforced as a double-layered structure between the predetermined level and the lower rim of the guard net.

8. A shock-absorbing fence comprising:

a plurality of main posts provided to stand at a predetermined interval a guard net having an upper rim and a lower adjacent to a ground surface rim both secured to the main posts;

a safety net extending between the main posts and having a lower rim secured to the ground surface and an upper rim attached to the guard net at a predetermined level higher than the lower rim of the guard net such that the safety net and the guard net overlap to form an area reinforced as a double-layered structure between the predetermined level and the lower rim of the guard net;

a plurality of hillside anchors;

a plurality of main post support rope members each coupled between the main posts and a respective one of the hillside anchors to tether the main posts to the ground surface; and a plurality of safety net support rope members each coupled between the lower rim of the safety net and a respective one of the hillside anchors to secure the safety net to the ground surface; and a horizontal support rope member provided along the lower rim of the safety net to assist in securing the safety net to the ground surface, the plurality of safety net support ropes connected between the plurality of hillside anchors and a plurality of points of the horizontal support rope member, wherein the safety net is configured such that, when the guard net receives falling objects and moves toward a deflected configuration in which the lower rim of the guard net is deflected away from the hillside anchors, the safety net extends from a slack configuration in which the safety net includes slack between the upper rim of the safety net that is attached to the guard net and the lower rim of the safety net that is secured to the ground surface toward an extended configuration in which the safety net extends between the guard net and the ground surface to prevent a gap below the guard net.

9. The shock-absorbing fence of claim 8 wherein the guard net is positioned such that the extensibility of the guard net is greater in a transverse direction of the guard net than a longitudinal direction of the guard net, and wherein the safety net is positioned such that the extensibility of the safety net is greater in a longitudinal direction of the safety net than a transverse direction of the safety net.

* * * * *

UNITED STATES PATENT AND TRADEMARK OFFICE

CERTIFICATE OF CORRECTION

PATENT NO. : 8,079,571 B2
APPLICATION NO. : 12/850427
DATED : December 20, 2011
INVENTOR(S) : Yoichi Nishita et al.

It is certified that error appears in the above-identified patent and that said Letters Patent is hereby corrected as shown below:

Column 8, Lines 59-62:
"guard net and having a lower rim secured to the ground surface;
a plurality of main post support rope members, each main" should read,
--guard net and having a lower rim secured to the ground surface;
a plurality of hillside anchors;
a plurality of main post support rope members, each main--.

Column 10, Line 6-7:
"a guard net having an upper rim and a lower adjacent to a ground to a ground surface rim both secured to the main posts;" should read, --a guard net having an upper rim and a lower rim adjacent to a ground surface both secured to the main posts;--.

Signed and Sealed this
Twenty-ninth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,079,571 B2
APPLICATION NO. : 12/850427
DATED : December 20, 2011
INVENTOR(S) : Yoichi Nishita et al.

It is certified that error appears in the above-identified patent and that said Letters Patent is hereby corrected as shown below:

Column 8, Line 67:
"coupled between the lower rim of the safety net a respective" should read, --coupled between the lower rim of the safety net and a respective--.

Signed and Sealed this
Twentieth Day of November, 2012

David J. Kappos

David J. Kappos
*Director of the United States Patent and Trademark Office*